United States Patent [19]

Coe et al.

[11] 4,065,257

[45] Dec. 27, 1977

[54] INHIBITION OF DYE STAINING DURING LAUNDERING OF TEXTILE MATERIALS

[75] Inventors: Gervase Coe, Stockport; Frank Lee, Dukinfield, both of England

[73] Assignee: Ciba-Geigy Corporation, Ardsley, N.Y.

[21] Appl. No.: 597,861

[22] Filed: July 18, 1975

Related U.S. Application Data

[63] Continuation of Ser. No. 334,814, Feb. 22, 1973, abandoned.

[51] Int. Cl.[2] ..... D06P 5/06

[52] U.S. Cl. ..... 8/74; 8/100 R; 8/134

[58] Field of Search ..... 8/74, 80, 100, 134; 252/110, 117

[56] References Cited

U.S. PATENT DOCUMENTS

| | | | |
|---|---|---|---|
| 2,080,543 | 5/1937 | Münz et al. | 8/5 |
| 2,189,807 | 2/1940 | Lenher et al. | 8/134 |
| 3,067,143 | 12/1962 | Walles et al. | 8/134 |
| 3,334,960 | 8/1967 | Abel | 8/54 |
| 3,700,600 | 10/1972 | Nagel et al. | 252/99 |
| 3,897,347 | 7/1975 | Eckert et al. | 252/110 |

FOREIGN PATENT DOCUMENTS

| | | |
|---|---|---|
| 680,245 | 8/1939 | Germany. |
| 1,088,173 | 1/1958 | Germany. |
| 1,965,074 | 7/1971 | Germany. |
| 1,011,408 | 12/1965 | United Kingdom. |
| 702,695 | 1/1954 | United Kingdom. |
| 878,021 | 9/1961 | United Kingdom. |
| 1,027,898 | 4/1966 | United Kingdom. |

*Primary Examiner*—William E. Schulz
*Attorney, Agent, or Firm*—Edward McC. Roberts; Prabodh I. Almaula

[57] ABSTRACT

A method for inhibiting dye-staining during laundering of textile articles with compositions which consist of a soap or detergent composition comprising as dye-staining inhibitor a. a minor proportion of an organic compound containing at least one basic nitrogen atom to which is bound at least one residue containing a polyglycol ether chain, the molecule of this compound containing at least 3 groups having the formula

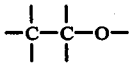

(I)

and containing at least 4 carbon atoms not attached to these groups, and/or b. a minor proportion of a reaction product of an aliphatic tertiary polyamine with an aliphatic dihalide.

17 Claims, No Drawings

INHIBITION OF DYE STAINING DURING LAUNDERING OF TEXTILE MATERIALS

This is a continuation of application Ser. No. 334,814, filed on Feb. 22, 1973, now abandoned.

The present invention relates to the use of dyeing auxiliaries to inhibit dye staining during laundering of textile articles.

Dye staining of textile articles during laundering occurs when articles which have been dyed with dyes of poor wash fastness are washed together with undyed articles or with articles dyed with dyes which have adequate fastness to washing. Dye-staining problems can also occur during the washing of fabrics which, although dyed with dyestuffs of adequate wash-fastness, are inadequately fast because the dyestuff has not been adequately fixed on to the fabric. Unfortunately, articles from which loosely held dyestuff is liable to bleed are not always identified as such nor is it possible to predict, merely by visual examination, whether a dyed fabric will or will not prove to be fast to washing. Of course, if dye staining occurs, the articles affected may be rendered completely unsuitable for further use.

We have now found that certain condensation products derived from organic amino compounds, when incorporated into soaps or detergents, inhibit dye staining of textile articles during laundering.

According to the present invention, there is provided a soap or detergent composition comprising as a dye stain-inhibitor, a. a minor proportion of an organic compound containing at least one basic nitrogen atom to which is bound at least one residue containing a polyglycol ether chain, the molecule of this compound containing at least three groups having the formula

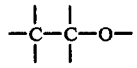

and containing at least four carbon atoms not attached to these groups, and/or b. a minor proportion of a reaction product of an aliphatic tertiary polyamine with an aliphatic dihalide.

The compounds of component (a) are known from British Patent No. 878,021 to be used as dyeing auxiliaries and levelling agents in the dyebath for the dyeing of nitrogenous fibres with a certain defined class of fibre-reactive, acid dyestuffs.

The compounds of component (b) are known from British Patent No. 702,695 for use in the dyeing of cellulose fibres with direct dyestuffs in an aqueous medium in combination with soluble copper compounds to improve the fastness qualities of the dyeings.

The German Patent Application (Auslegeschrift) No. 1,123,784 describes a non-ionic compound of the formula

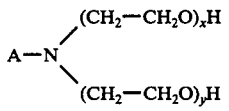

wherein A represents an alkyl group with 12 to 22 carbon atoms, $x$ is a number from 5 to 500 and $y$ is a number from 0 to 500, which compound may be an optional component of an antifoaming agent in a detergent composition.

The soap or detergent composition according to the present invention may be any soap or detergent composition suitable for washing textile articles. Suitable soaps and detergent compositions are described, for instance, in the text-book "Domestic and Industrial Chemical Specialities" by L. Chalmers, Leonard Hill, London, 1966, in which the chapter headed "Synthetic Detergents" is of particular relevance.

Synthetic detergents contain either a non-ionic or, more usually an anionic surface-active agent. Examples of non-ionic surfactants which are suitable are polyalkylene glycol derivatives of long-chain fatty amines or of long-chain fatty alcohols. Typical examples of suitable anionic surfactants are alkali metal alkyl sulphates, ammonium alkyl sulphates, alkali metal alkaryl sulphates and ammonium alkaryl sulphates.

The proportion of surfactant in the synthetic detergent composition is normally used in amounts of up to 40% by weight, most commonly from 10 to 30% by weight based on the total weight of the composition.

Further additives which are usually included in synthetic detergent compositions are builders, bleaching agents, dirt-suspending agents, fillers, optical brightening agents, enzymes and mild perfumes.

Suitable bleaching agents which may be used include per-carbonates or persulphates or, more usually, alkali metal perborates. Suitable fillers include alkali metal sulphates, silicates and phosphates; a dirt-suspending agent which is often used is carboxymethyl cellulose. Conventional optical brighteners are those of the triazinyl-diamino-stilbene disulphonic acid, aminocoumarin, pyrazoline, imidazolone, benzidine sulphone bisoxazole, distyryl diphenyl or dibenzimidazole types. Enzymes which are frequently used are those containing predominately a protease produced from a spore-forming *Bacillus subtilis* bacteria. A suitable perfume is one having a citrus, cologne or pine base.

If a dye-staining inhibitor of type (a) is employed, it contains at least one basic nitrogen atom to which is bound at least one residue containing a polyglycol ether chain which consists of at least two groups of the formula

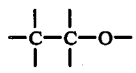

(I)

and the chain may be bound directly, or through a bridge member, for example an alkylene residue such as the residue of the formula

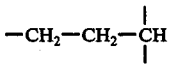

(II)

to the nitrogen atom. The molecule of the nitrogen compound must contain at least three groups of the formula

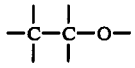

(I)

which are advantageously groups of the formula $$-CH_2-CH_2-O- \quad \text{(III).}$$

Furthermore, the nitrogen compound must contain at least four carbon atoms not attached to a group of the formula

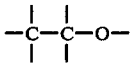

(I).

The nitrogen compound advantageously also contains at least one aliphatic or alicyclic residue having at least 8 carbon atoms bound to one another, preferably an aliphatic residue having at least 12 carbon atoms bound to one another, or, less preferably, the nitrogen compound also contains an aromatic residue having an aliphatic side chain and being bound by an aryl carbon atom to the basic nitrogen atom.

Especially suitable inhibitors of type (a) are reaction products of at least three moles of an $\alpha,\beta$-alkylene oxide with one mole of an organic compound which contains at least one basic primary or secondary amino group or a basic tertiary amino group as well as an alcoholic hydroxyl group, and acid salts or quaternary ammonium salts of these compounds.

As starting materials for these reaction products there may be used as $\alpha,\beta$-alkylene oxides, ethylene oxide, propylene oxide or glycide. Especially useful products are obtained from ethylene oxide.

As organic compounds which contain at least one basic primary or secondary amino group or a basic tertiary amino group and also an alcoholic hydroxyl group, there may be used amines of the aliphatic, aromatic or alicyclic series. Suitable aliphatic compounds which may be mentioned are monamines such as diethylamine, butylamine, hexylamine, dodecylamine, cetylamine, oleylamine, octadecylamine, arachidylamine, behenylamine or mixtures of these monamines, or polyamines such as ethylene diamine, propylene diamine, triethylene tetramine or the corresponding N-alkyl-polyamines containing alkyl groups having 8 to 22 carbon atoms. There may also be mentioned basic derivatives of such amines, and esters of oxy-amines with higher fatty acids, for example, triethanolamine coconut oil fatty acid ester, or partial amides of polyamines with fatty acids, for example, triethylene tetramine monoacylated with coconut oil fatty acid. Suitable amines of the aromatic series which may be mentioned are above all amines of the benzene or naphthalene series with alkyl side chains containing for example, 8 to 18 carbon atoms. Suitable alicyclic compounds which may be advantageously used are resin amines, such as abietylamine, abietyl-methylamine, the amine mixture of tall oil which mixture contains resin amines in addition to higher alkylamines, or hydrogenated abietylamine. Amidines, such as lauric acid amidine or stearic acid amidine may also be used.

For the purpose of this invention suitable products of the type (a) are those obtainable by reacting 1 mole of an amine with at least 3, for example 3 to 20 moles of an alkylene oxide, for example, the reaction product of one mole of dodecylamine with about 6 moles of ethylene oxide or of 1 mole of oleylamine with 6, 8 or 16 moles of ethylene oxide, or of 1 mole of stearyl amine with 4, 8 or 16 moles of ethylene oxide, the reaction product of 1 mole of a mono-alkyl-propylene diamine, of which the alkyl group is the residue of tallow fatty acid, with 8 moles of ethylene oxide, or the reaction product of 1 mole of a monoalkylpropylene diamine, of which the alkyl group is unbranched, and contains sixteen to eighteen carbon atoms, with 6 moles of ethylene oxide.

Nitrogen compounds of the formula

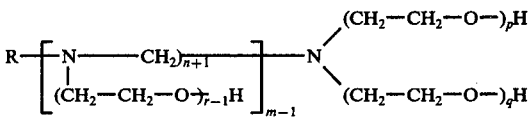

(IV)

are especially suitable for use in this invention, wherein R represents an advantageously unbranched aliphatic hydrocarbon radical containing at least 12, and advantageously 16 to 22, carbon atoms, $m$ and $n$ each represent the whole number 1 or 2, and $p$, $q$ and $r$ represent whole numbers such that the sum $p+q+(m-1)(n-1)$ is at least 3 and at most 20.

Especially preferred are compounds of the formula

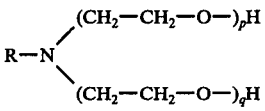

(V)

wherein R represents an advantageously unbranched aliphatic hydrocarbon radical containing at least 12, and advantageously 16 to 20 carbon atoms, and $p$ and $q$ each represent a whole number such that the sum $p+q$ is at least three and advantageously 8 to 16.

Instead of compounds containing free oxyalkyl groups, there may be used the acid esters of these oxyalkyl compounds with polybasic acids, for example, phosphoric or sulphuric acid, or the water-soluble salts of these esters, for example the alkali metal or ammonium salts or amine salts.

The ethylene oxide addition products are made by the methods customary for making such products. They can be made, for example, by reacting the components at a raised temperature. Advantageously the alkylene oxide is not added to the amine all at once, but gradually by introducing the alkylene oxide, for example, in the gaseous or liquid state, into the amino compound at a temperature at which the alkylene oxide reacts, for example, at 50° to 200° C. If desired, the reaction may be carried out in a closed vessel under superatmospheric pressure, advantageously at 2 to 10 atmospheres gauge pressure. The reaction mixture may, if necessary, contain a catalyst. As a catalyst there is advantageously used a substance of alkaline reaction, such as metallic sodium, an alkali metal hydroxide or carbonate or an alkali metal salt of a carboxylic acid of low molecular weight.

The condensation products used in the process are soluble or easily dispersible in water. The solubility in water way, if desired, be increased by introducing groups enhancing solubility in water. Thus for example, quaternary ammonium salts may be used which contain alkylene glycol chains derived from α,β-alkylene oxides and are obtained, for example, by the additive combination of an alkylating agent with a reaction product of a primary, secondary or tertiary amine of the kind mentioned above with the alkylene oxide. There may be mentioned the quaternary ammonium salt which is obtained by quaternating with dimethyl sulphate the reaction product of oleylamine with 6 to 10 molecular proportions of ethylene oxide.

Instead of reaction products of alkylene oxide with primary, secondary or tertiary amines of the kind mentioned above, products may be used which are obtained by introducing into the amines polyglycol ether chains having the appropriate number of ether groups.

Dye-staining inhibitors of type (b) are higher molecular polyquaternary ammonium compounds. These compounds are polymers obtained by reacting aliphatic tertiary polyamines with aliphatic dihalides.

The higher molecular polyquaternary ammonium compounds are obtained in a simple manner by converting the aliphatic tertiary polyamines (the term polyamines being used herein to include diamines) at a raised temperature with the dihalides into quaternary polyamines. The reaction is performed by heating the components to a temperature of between 50° and 140° C and is generally completed within a few hours. The reaction can take place optionally in the presence of solvents such as butyl alcohols, ethylene glycol or diethylene glycol. Generally, increased pressure is unnecessary.

Chiefly di-, tri- and tetramines such as N,N'-tetramethylhexamethylene diamine and homologues, N,N'-tetramethyl-triglycol diamine, N,N',N''-pentamethyldiethylene triamine and N,N',N'',N'''-hexamethyltriethylene tetramine and also its technical mixtures come into consideration as aliphatic tertiary polyamines.

Suitable aliphatic dihalides are, for example, alkyl dihalides such as 1,2-dichloro- or -dibromethane, 1,3-dichloropropane, 1,4-dichloro-butane, 1,5-dichloropentane, 1,6-dichlorohexane, 1,4-dibromopentane, 2,3-dichlorobutane and 1-chloro-2-bromoethane, and also dihalides derived from glycol ethers such as β,β'-dichlorodiethyl ether, ethylene glycol-di-β-chloroethyle ether, tetraethylene gylcol dichloride, γ,γ'-dichloropropyl ether as well as glycerine dichlorohydrin.

The proportion of dye-staining inhibitor which it is necessary to include in the soap or detergent composition in order to minimise dye staining varies according to the nature of the textile, the degree of wash-fastness of the staining dye and the severity of the washing conditions, in terms for instance of wash temperature, wash time and the alkalinity of the wash liquor. For most purposes, however, a proportion of dye-staining inhibitor within the range of from 1 to 50% by weight, preferably from 15 to 40% by weight, based on the total weight of dry soap or detergent composition, is adequate.

The dye-staining inhibitor may be incorporated into the soap or detergent composition in the solid phase by any conventional technique such as tumbling, milling, etc. Alternatively, an aqueous detergent/inhibitor slurry may be prepared and then spray-dried to give solid detergent powder in bead form. If desired, the solid detergent powder so produced may be dissolved in water to give aqueous detergent compositions.

According to the present invention, there is also provided a method by which dye staining of textiles during washing is inhibited, comprising contacting the textile articles to be washed, during the washing process, with a. a minor proportion of an organic compound containing at least one basic nitrogen atom to which is bound at least one residue containing a polyglycol ether chain, the molecule of this compound containing at least 3 groups having the formula

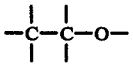

and containing at least 4 carbon atoms not attached to these groups, and/or b. a minor proportion of a reaction product of an aliphatic tertiary polyamine with an aliphatic dihalide.

The method according to the invention can be successfully applied to inhibit dye-staining of a wide variety of types of textile articles. However, the method of the invention is particularly successful in inhibiting (i) dye-staining by cellulosic articles dyed with dyes of poor wash-fastness on to undyed cotton or on to cotton dyed with wash-fast dyes, (ii) dye-staining by polyamide articles dyed with dyes of poor wash-fastness on to undyed cellulosics or polyamide or on to cellulosics or polyamide dyed with wash-fast dyes and (iii) dye-staining by cellulosic or polyamide fabrics each dyed with a dyestuff of poor wash-fastness on to dyed or undyed cellulosic or polyamide articles. For inhibiting dye-staining of type (i), dye-staining inhibitors of type (b) are particularly effective and to inhibit dye-staining of type (ii), dyestaining inhibitors of type (a) are specially recommended, and in the type (iii) dye-staining situations, a mixture of inhibitors (a) and (b) is especially recommended in order to minimise dye-staining.

The following examples illustrate the invention. Parts and percentages are by weight unless otherwise stated. Temperatures are given in degrees centigrade.

EXAMPLE 1

(a) 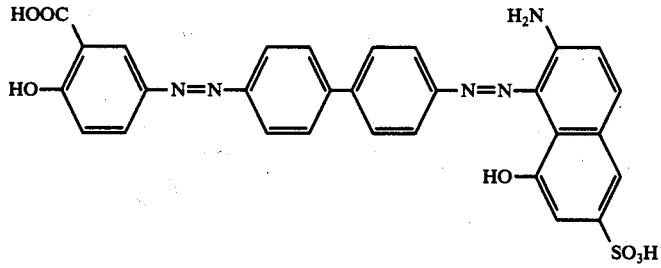

red

-continued (b) 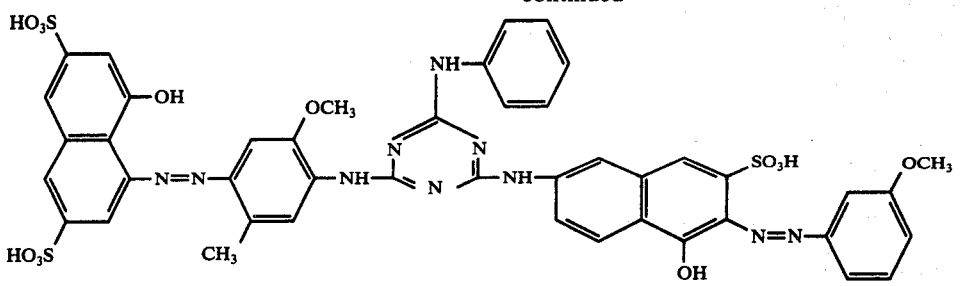 red (c) 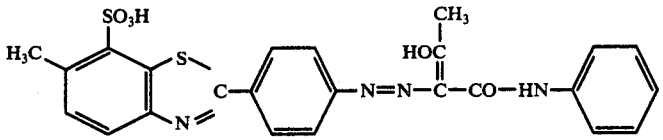 yellow (d) 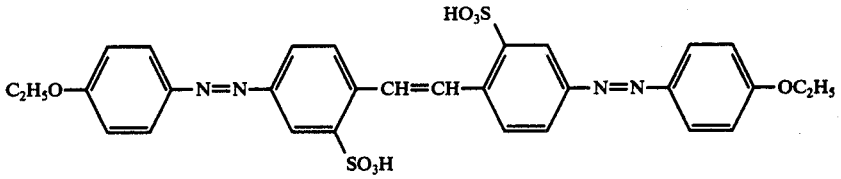 yellow (e) 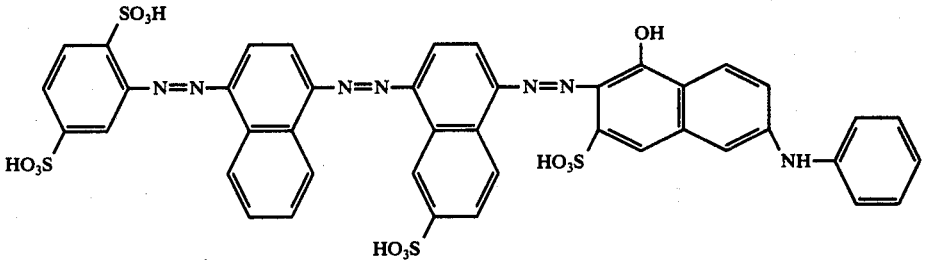 blue (f) 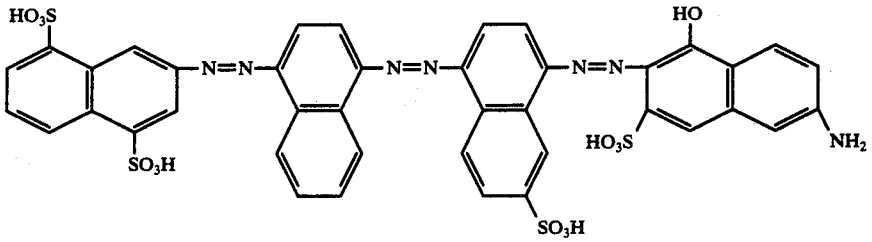 blue Separate samples of cotton sateen fabric were dyed respectively in conventional manner with 1.5% of one of the above-listed dyestuffs.

These dyes are direct dyes having a low wash-fastness and producing a medium shade.

Each of the cotton sateen samples was then prewashed in 5 g/l of a heavy-duty synthetic detergent for 10 minutes at 60°, using a liquor ratio of 1:20 in order to remove excessive surface dye.

Then 3 g of dyed cotton fabric and 3 g of undyed cotton fabric were washed in 5 g/l of a heavy-duty, anionic synthetic detergent for 10 minutes at 60° using a goods to liquor ratio of 1:20. The washing was carried out in a Launderometer as follows: The cans containing 5 g/l of the heavy-duty synthetic detergent being preheated to 60°, 2 g/l of the condensation product of pentamethyl diethylene triamine with dichlorodiethyl ether were then added, ensuring that it was dispersed in the solution. The samples were then added to the cans, the cans were placed in the machine and rotated for 10 minutes. The cans were removed, the samples rinsed and dried and examined visually for bleeding.

Minimal bleeding of dye from the dyed on to the undyed samples was observed in any of the blue, red or yellow dyeings, whereas in a control experiment, i.e. when the above condensation product was omitted, severe dye staining occured.

If the above procedure is repeated using 0.8 g/l of the condensation product instead of 2 g/l thereof, similar good results are obtained.

EXAMPLE 2

(a) 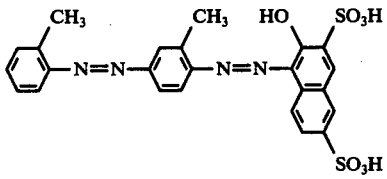 red

-continued (b) blue

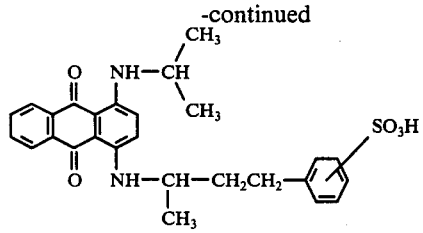

(c) blue

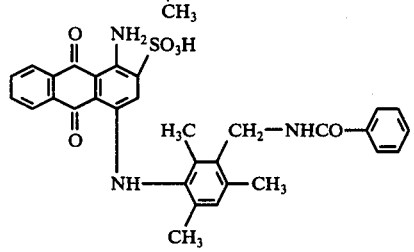

(d) red

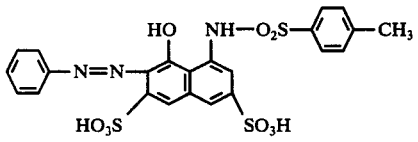

Separate samples of texturized polyamide (Helanca) fabric were dyed in conventional manner with 1.5% of one of the above-listed dyestuffs.

Each of these dyes are acid dyes and were chosen because of their low wash-fastness and the fact that they produce medium shades.

3 g of the dyed polyamide fabrics were then washed together with 3 g of undyed cotton sateen fabric in the manner described in Example 1, except that instead of 2 g/l of the condensation product used therein, 2 g/l of a condensation product prepared in the manner described in part (a) of Example 7 of British Patent Specification No. 878,021 was used.

Minimal bleeding of dye from the dyed on to the undyed pattern was observed in any of the blue or red dyeings, whereas in a control experiment, i.e. using no condensation product, severe dye staining occurred.

EXAMPLE 3

Example 2 was repeated except that in the washing procedure polyamide fabric which had been dyed with 1.5% of the blue dyestuff (b) was washed together with undyed polyamide; minimal dye-staining of the undyed sample by bleeding from the dyed sample was observed.

Similar results were obtained when this procedure was repeated but using polyethoxylated amines each derived from stearylamine, which was condensed respectively with 5, 10 or 15 ethylene oxide units, or one of the following polyethoxylated amines each containing 5 oxyethylene groups, and derived respectively from coco fatty acid, oleic acid, soya fatty acid, tallow fatty acid or stearic acid, or an ethoxylated diamine derived from tallow fatty acid having 3 oxyethylene groups or derived from tallow fatty acid having 10 oxyethylene groups.

EXAMPLES 4 to 7

5 g/l of a non-ionic synthetic detergent composition containing no perborate or optical brightening agent was treated with 0.15% of one of the dyestuffs given in Example 2, calculated on the weight of the fabric. To this detergent/dye liquor (goods to liquor ratio of 1:40), the dye-staining inhibitor given in Example 2 was added in the amounts given in the following table and the whole was thoroughly mixed. Then an undyed sample of undyed polyamide 6.6 fabric was added. Washing was carried out for 10 minutes at 60°. The fabric was then removed, rinsed, dried and examined visually for staining.

Table

| Example | Proportion of Inhibitor g/l | Degree of Staining |
|---|---|---|
| 4 | 0.5 | low |
| 5 | 1.0 | ↓ |
| 6 | 1.5 | |
| 7 | 2.0 | decreasing |

Similar results were obtained when (a) the substrate was changed from nylon 6.6 to cotton, (b) the dyestuff was replaced by one of the dyestuffs given in Example 1 using a nylon 6.6 substrate, (c) a cotton substrate was dyed with one of the dyestuffs of Example 1 using the dye-staining inhibitor given in Example 1 and (d) a nylon 6.6 substrate was dyed with one of the dyestuffs given in Examples 1 and 2 using a mixture of the dye-staining inhibitors given in Examples 1 and 2.

EXAMPLES 8 to 13

Separate samples of cotton sateen fabric were dyed in conventional manner with 1.5% of the blue dyestuff (f) of Example 1.

Then 3 g of dyed cotton fabric and 3 g of undyed cotton fabric were washed in 5 g/l of a heavy-duty anionic synthetic detergent for 10 minutes at 60° using a goods to liquor ratio of 1:20. The washing was carried out using the procedure described in Example 1. However, instead of using the dye-staining inhibitor used in Example 1, various mixtures of the dye-staining inhibitors used in Example 1 and Example 2 were used, the relative proportions of the components being as shown in the following table.

Table

| Example | Concentration of Inhibitor of Example 1 (g/l) | Concentration of Inhibitor of Example 2 (g/l) |
|---|---|---|
| — | nil | nil |
| 8 | 1.0 | 2.0 |
| 9 | 0.5 | 2.0 |
| 10 | 0.1 | 2.0 |
| 11 | 1.0 | 1.0 |
| 12 | 1.0 | 0.5 |
| 13 | 0.5 | 1.0 |

In every case, the staining of the undyed fabric was minimal, whereas in control experiments, that is using no inhibitor, staining was very severe.

Very similar results were obtained when cotton fabric was dyed with 1.5% of the yellow dyestuff (c) of Example 1 and then this dyed fabric was washed in a similar manner with undyed polyamide fabric.

EXAMPLES 14 to 22

A sample of cotton sateen fabric was washed with 5 g/l of a non-ionic synthetic detergent at 60° for 10 minutes (goods to liquor ratio 1:20) followed by thorough rinsing.

In a series of tests a solution of the following dyestuff mixture, i.e. 0.15% of one of the blue dyestuffs of Example 2, 0.15% of one of the blue dyestuffs of Example 1 and 0.015% of one of the yellow dyestuffs of Example 1 was added respectively to each test with liquor. To this wash/dye liquor was then added a composition of one of the dye-staining inhibitor mixtures given in the following table.

Table

| Example | Concentration of dye-staining inhibitor of Example 2 (g/l) | Concentration of dye-staining inhibitor of Example 1 (g/l) |
|---|---|---|
| — | nil | nil |
| 14 | 2.0 | 1.0 |
| 15 | 2.0 | 0.5 |
| 16 | 2.0 | 0.25 |
| 17 | 2.0 | 0.1 |
| 18 | 1.5 | 1.0 |
| 19 | 1.0 | 1.0 |
| 20 | 0.5 | 1.0 |
| 21 | 1.0 | 0.25 |
| 22 | nil | 1.0 |

The addition of the dye-staining inhibitor compositions of the invention gave much reduced dye-staining of the cotton fabric for each dyestuff compared with the control experiment using no inhibitor.

EXAMPLES 23 to 32

A polyamide 6.6 sample was washed and dyed under the conditions described in Examples 14 to 22, except that the dyestuff solutions had the following composition: 0.15% of one of the blue dyestuffs of Example 2, 0.015% of one of the blue dyestuffs of Example 1 and 0.015% of one of the yellow dyestuffs of Example 1.

The constitution of the dye-staining inhibitor compositions used are set out in the following table.

Table

| Example | Concentration of dye-staining inhibitor of Example 2 (g/l) | Concentration of dye-staining inhibitor of Example 1 (g/l) |
|---|---|---|
| — | nil | nil |
| 23 | 2.0 | 1.0 |
| 24 | 2.0 | 0.5 |
| 25 | 2.0 | 0.25 |
| 26 | 2.0 | 0.1 |
| 27 | 2.0 | nil |
| 28 | 1.5 | 1.0 |
| 29 | 1.0 | 1.0 |
| 30 | 0.5 | 1.0 |
| 31 | 1.0 | 0.25 |
| 32 | nil | 1.0 |

The addition of the dye-staining inhibitor compositions of the invention gave much reduced dye-staining of the polyamide fabric for each dyestuff compared with the control experiment using no inhibitor.

Very similar results were obtained when mixed cotton/polyamide fabrics were washed in a non-ionic detergent in the presence of the same mixture of dyes and in the presence of the same range of dye-staining inhibitors.

EXAMPLES 33 to 42

1.0 g of cotton dyed with 1.5% of the blue dyestuff (f) of Example 1, 1.0 g cotton dyed with 1.5% of the yellow dyestuff (c) of Example 1, 1.0 g of polyamide 6.6 dyed with 1.5% of the blue dyestuff (b) of Example 2, 1.5 g of undyed cotton and 1.5 g of undyed polyamide 6.6 were washed together with 5 g/l of a non-ionic detergent at 60° for 10 minutes (goods to liquor ratio 1:40), followed by thorough rinsing.

On of the dye-staining inhibitor compositions given in the following table was present during separate washing tests.

Table

| Example | Concentration of dye-staining inhibitor of Example 2 (g/l) | Concentration of dye-staining inhibitor of Example 1 (g/l) |
|---|---|---|
| — | nil | nil |
| 33 | 2.0 | 1.0 |
| 34 | 2.0 | 0.5 |
| 35 | 2.0 | 0.25 |
| 36 | 2.0 | 0.1 |
| 37 | 2.0 | nil |
| 38 | 1.5 | 1.0 |
| 39 | 1.0 | 1.0 |
| 40 | 0.5 | 1.0 |
| 41 | 1.0 | 0.25 |
| 42 | nil | 1.0 |

Dye-staining of the undyed samples was very much reduced when a dye-staining inhibitor composition of the invention was present in the wash liquor, compared with the dye-staining observed in the control experiment.

We claim:

1. A method for inhibiting the dye-staining of textiles during washing comprising contacting the textile articles during the washing process with (a) a reaction product of at least three molecular proportions of an $\alpha,\beta$-alkylene oxide with one molecular proportion of an organic compound which contains at least one basic primary or secondary amino group or a basic tertiary amino group as well as an alcoholic hydroxyl group or is an acid salt or a quaternary ammonium salt of such a reaction product, and (b) of a reaction product of an aliphatic tertiary polyamide with an aliphatic dihalide or (b) of a reaction product of an aliphatic tertiary polyamine with an aliphatic dihalide. Wherein the proportions of (a) and (b) are each 0.25 grams per liter to 2 grams per liter of the wash water.

2. A method as claimed in claim 1 wherein an anionic or non-ionic surfactant is present.

3. A method as claimed in claim 2 wherein the anionic surfactant is an alkali metal alkyl sulphate, an ammonium alkyl sulphate, an alkali metal alkaryl sulphate or an ammonium alkaryl sulphate.

4. A method as claimed in claim 2, wherein the non-ionic surfactant is a polyalkylene glycol derivative of a long-chain fatty amine or long-chain fatty alcohol.

5. A method as claimed in claim 1 wherein the $\alpha,\beta$-alkylene oxide starting-material is ethylene oxide.

6. A method as claimed in claim 1 wherein the organic compound starting-material is an aliphatic, aromatic or alicyclic amine.

7. A method as claimed in claim 1 wherein the component (a) has the formula

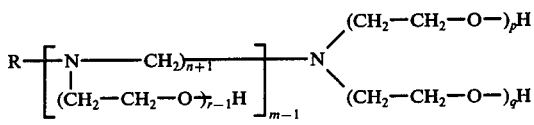

(IV)

wherein R is an aliphatic hydrocarbon radical containing at least 12 carbon atoms, $m$ and $n$ are each 1 or 2 and $p$, $q$ and $r$ are whole numbers such that the sum of $p+q+(m-1)(n-1)$ is at least 3 and at most 20.

8. A method as claimed in claim 7 wherein R is an unbranched radical containing 16 to 22 carbon atoms.

9. A method as claimed in claim 7 wherein the component (a) has the formula

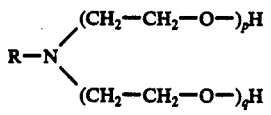

(V)

wherein R is an aliphatic hydrocarbon radical contaning at least 12 carbon atoms and $p$ and $q$ each represent a whole number, such that the sum of $p+q$ is at least 3.

10. A method as claimed in claim 9 wherein R is an unbranched radical containing from 16 to 20 carbon atoms and the sum of $p+q$ is from 8 to 16.

11. A method as claimed in claim 1 wherein component (a) is the reaction product of one mole of dodecylamine with 6 moles of ethylene oxide, one mole of oleylamine with 6, 8 or 16 moles of ethylene oxide, or of one mole of stearyl amine with 4, 8, or 16 moles of ethylene oxide, the reaction product of one mole of mono-tallow alkyl-propylene diamine with 8 moles of ethylene oxide or the reaction product of 1 mole of a mono-$C_{16}$-$C_{18}$ unbranched alkyl-propylenediamine with 6 moles of ethylene oxide.

12. A method as claimed in claim 1 wherein the component (b) is the reaction product of an aliphatic dihalide with N,N'-tetramethyl-hexamethylene diamine or its homologues, N,N'-tetramethyl-tri-glycol diamine, N,N',N''-pentamethyldiethylene triamine or N,N',N'',N'''-hexamethyl-triethylene tetramine or technical mixtures thereof.

13. A method as claimed in claim 1 wherein a cellulosic textile article dyed with a dyestuff of poor wash-fastness is washed together with undyed cotton material or cotton material dyed with wash-fast dyes to inhibit dye-staining from said cellulosic textile article on to said undyed or dyed cotton material.

14. A method as claimed in claim 13 wherein the dye-staining inhibitor is component (b) alone.

15. A method as claimed in claim 1 wherein a polyamide textile article dyed with a dyestuff of poor wash-fastness is washed together with undyed cellulosic or polyamide material or with cellulosic or polyamide material dyed with wash-fast dyes to inhibit dye-staining from said polyamide textile article on to said undyed or dyed cellulosic or polyamide material.

16. A method as claimed in claim 1 wherein a cellulosic or polyamide textile article, each dyed with a dyestuff of poor wash-fastness, is washed together with dyed or undyed cellulosic or polyamide material to inhibit dye-staining from said cellulosic or polyamide textile article on to said dyed or undyed cellulosic or polyamide material.

17. A method as claimed in claim 16 wherein the dye-staining inhibitor is a mixture of components (a) and (b).

* * * * *